United States Patent [19]

Southard

[11] 3,994,641

[45] Nov. 30, 1976

[54] ROTARY POSITIVE FLUID DISPLACEMENT MACHINE

[76] Inventor: Albert A. Southard, 111 W. Parkway, Salina, Kans. 67401

[22] Filed: Nov. 11, 1974

[21] Appl. No.: 522,500

Related U.S. Application Data

[63] Continuation-in-part of Ser. No. 322,430, Jan. 10, 1973, abandoned.

[52] U.S. Cl. ..... 418/93; 418/156; 418/269

[51] Int. Cl.[2] ..... F01C 5/04

[58] Field of Search ..... 418/87, 93, 117, 156, 418/267, 268, 269

[56] References Cited

UNITED STATES PATENTS

| | | | |
|---|---|---|---|
| 710,577 | 10/1902 | Hawkins | 418/134 |
| 1,121,628 | 12/1914 | Hoffmann | 123/8.45 |
| 2,049,092 | 7/1936 | Sturm | 418/87 X |

FOREIGN PATENTS OR APPLICATIONS

| | | | |
|---|---|---|---|
| 512,151 | 4/1955 | Canada | 418/93 |
| 5,456 | 12/1955 | Germany | 418/117 |
| 637,429 | 3/1962 | Italy | 418/266 |
| 343,988 | 10/1936 | Italy | 418/148 |
| 425,094 | 9/1947 | Italy | 418/87 |
| 36,643 | 4/1968 | Japan | 418/117 |
| 661,216 | 11/1951 | United Kingdom | 418/93 |
| 692,690 | 6/1953 | United Kingdom | 418/269 |

*Primary Examiner*—Carlton R. Croyle
*Assistant Examiner*—Michael Koczo, Jr.
*Attorney, Agent, or Firm*—Robert E. Breidenthal

[57] ABSTRACT

A rotary positive fluid displacement machine wherein the radially reciprocable sealing vanes are hydraulically coupled to each other at their innermost ends for preventing the occurrence of compression opposition to radial retraction of the vanes and for urging radial outward movement of the vanes.

11 Claims, 10 Drawing Figures

FIG. 1
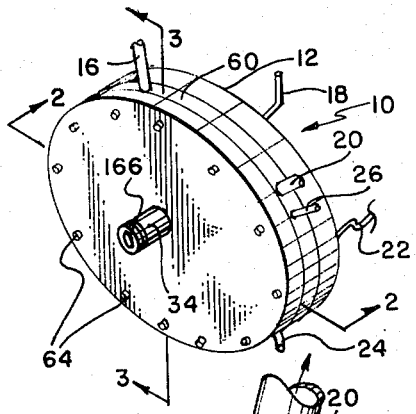
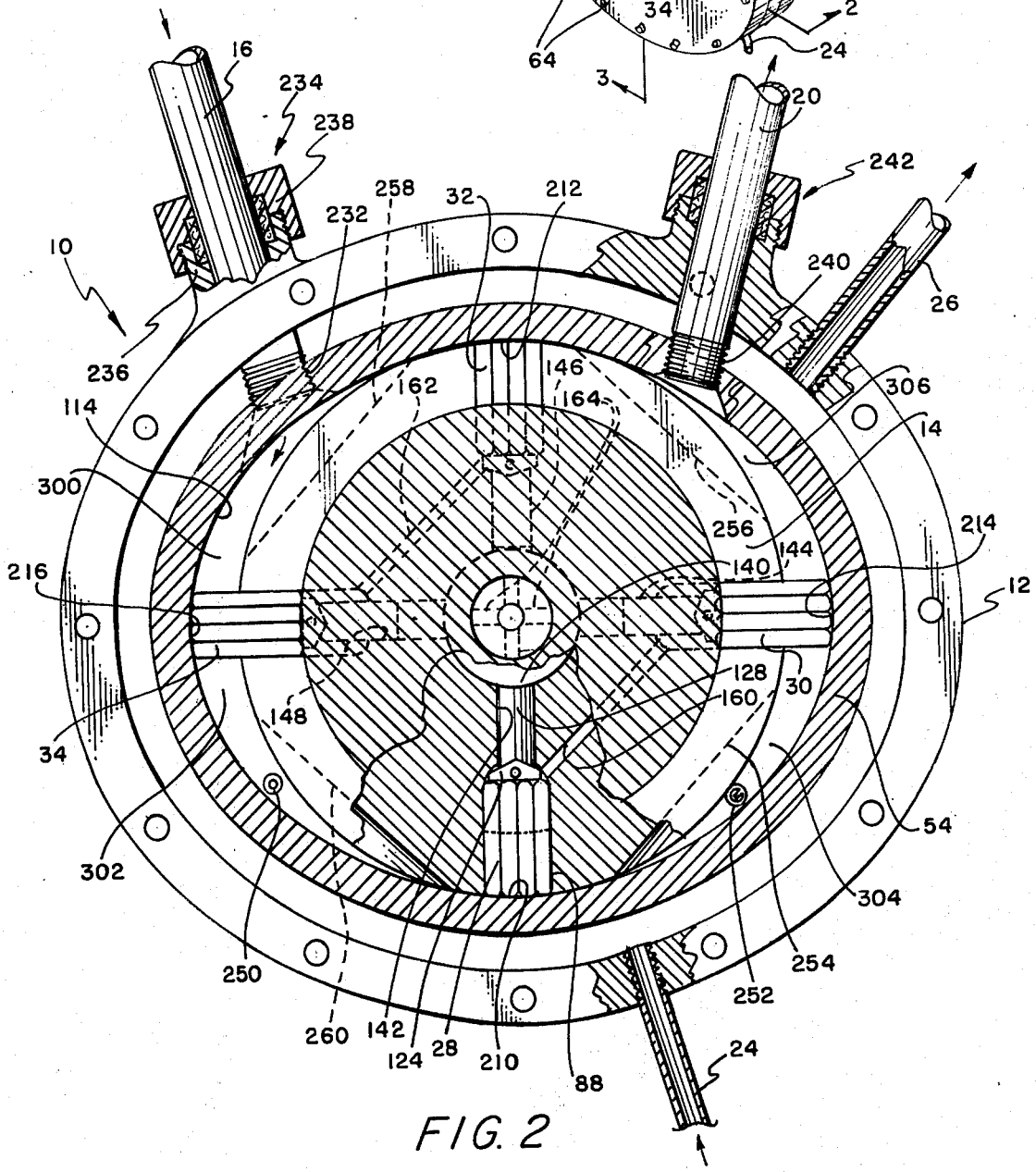
FIG. 2

ROTARY POSITIVE FLUID DISPLACEMENT MACHINE

This application is a continuation in part of an application filed Jan. 10, 1973, the same being entitled Rotary Internal Combustion Engine Having Cam Actuated Vanes and bearing Application Ser. No. 322,430, and now abandoned.

The present invention concerns, as does that disclosed in the aforementioned parent application, a rotary vane type of positive fluid displacement machine with provision of means for equalizing fluid pressures acting against the radially innermost ends of the vanes. In addition, the present invention pertains to other new and useful improvements in machines of such character, and more particularly relates to machines of such character wherein controlled hydraulic pressure is applied to urge radially outward movement of the vanes, and the provision of vanes such that each vane affords a multiplicity of sealing contacts with the housing.

Rotary machines of the type wherein moving variable volume chambers are defined between a noncircular housing wall and a rotor therein that carries vanes making sealing contact with the housing wall to separate the chambers from each other are well known and generally have utilization coextensive with the utility of variable volume spaces, notably as fluid pumps and as fluid actuated motors.

Machines of such type, whether applied to pumping or motor functions, have heretofore enjoyed only limited success for a number of reasons all too well known to those conversant with the art, amongst which may be mentioned the difficulty of effecting a seal between the radial extremity of a vane and the housing and to maintain the same over a prolonged period of usage, difficulties arising from the varying displacement by the vane such as within its mounting on the rotor, the difficulty or radially forcing a vane into sealing contact with a force that does not diminish on radial outward vane movement, the difficulty of economically manufacturing a housing having a noncircular wall of sufficient precision for effective sealing with the vanes, and the difficulties of economically manufacturing a machine of such general character that entails easily tolerable friction levels and which can be easily cooled.

It is the paramount aim of the instant invention to provide a machine of the general character defined above that will surmount or at least sufficiently reduce all the difficulties mentioned above as to enable practical utilization of the same in many pumping or motor operations, the advantages of rotary machines as contrasted with machines such as those involving reciprocating pistons being widely recognized.

For a background understanding of prior proposals in the art and a significant appreciation of the magnitude of the problems mentioned above and the importance of the aims of the present invention, attention is invited to the references cited during the prosecution of the above identified parent application and to the following United States patents. The patents listed below also afford an appreciation of the manner in which rotary fluid handling machines can be connected for pumping or motor purposes, and especially such provisions that can be made in the application of such machine principles to internal combustion engines:

| | | |
|---|---|---|
| 3,688,749 | Wankel | Sept. 5, 1972 |
| 3,319,611 | Terazawa | May 16, 1967 |
| 3,102,516 | Gist et al | Sept. 3, 1963 |

One broad aspect of the subject invention involves in rotary machines of the type handling fluids, wherein a pair of variable volume spaces are partially defined by and separated by a rotor carried radially extensible vane that contacts the noncircular inner wall surface of a housing disposed about the axis of the rotor, the improvement wherein said rotor has a way therein in which the vane radially moves slidingly and sealingly in a pistonlike manner, and fluid pressure means for continuously urging radially outward movement of the vane.

Another broad aspect of the subject invention involves in rotary machines of the type for handling fluids, wherein a pair of variable volume spaces are partially defined by and are separated by a rotor carried, radially extensible vane that contacts the noncircular inner wall surface of a housing disposed about the axis of the rotor, the improvement comprising said vane having radially outermost leading and trailing portions that are circumferentially spaced relative to the axis of the rotor, means for enabling relative radial movement of the leading and trailing portions of the vane, whereby both such portions can continuously contact the wall surface, and fluid pressure means for urging radial outward movement of the vane.

Yet another broad aspect of the invention involves in a fluid handling machine, wherein variable volume chambers disposed about an axis are in part defined by a noncircular inside surface of a housing, an improved housing comprising a pair of axially connected sections having facing sides, said sections having opposed noncircular annular grooves, and a non-circular annular wall having opposite extremities received in said grooves in an arrangement such that the noncircular inside surface of the housing is defined by said wall.

Still another broad aspect of the invention involves in a rotary fluid handling machine of the type wherein a rotor is mounted for rotation about its axis in a housing having a noncircular internal surface with said rotor being provided with a plurality of circumferentially spaced and radially movable vane means rotatable therewith that each has a radially outermost end in relatively movable and sealing engagement with said internal surface, and wherein said rotor has in association with each of said vane means a way therein that sealingly and reciprocatingly receives such vane means therein during radial movements of the latter, the improvement comprising passageway means affording free fluid communication radially between inner portions of all said ways for substantially equalizing such fluid pressures as may exist at the inner portions of the ways during rotation of the rotor, and a fluid having a viscosity less than about that of SAE 10w automotive motor oil filling said passageway means.

Other important aspects of the invention involve the provision of means for maintaining the fluid pressure in the passageways at a pressure exceeding a preselected minimum while also providing means for relieving fluid pressure in such passageways when the latter exceeds a still higher preselected maximum value.

The principles of the subject invention are disclosed in the context of application to the development of internal combustion engine power rather than in the context of the relatively more simple applications to the pumping of fluids or utilization as a motor driven by expansible fluids circulated thereto by remote pumps, steam boilers or the like, it being deemed well within the ordinary skills in the art to apply the disclosed principles to such other applications. Indeed, certain features of the invention can be readily applied to the fabrication of other types of internal combustion engines as, for example, to the noncircular housing and the cooling thereof, etc.

Numerous and other aims and features of the invention will become manifest upon considering a hereinafter described preferred embodiment of the invention, such description being given in conjunction with the accompanying drawings illustrative thereof, wherein:

FIG. 1 is an isometric illustration of the engine, the same being shown with the fluid reservoir removed and disconnected from its exhaust muffler, fuel air supply and source of electrical ignition potential;

FIG. 2 is an enlarged sectional view taken on the plane of the section line 2—2 in FIG. 1, with parts being broken away to show hidden details;

Figure 3:
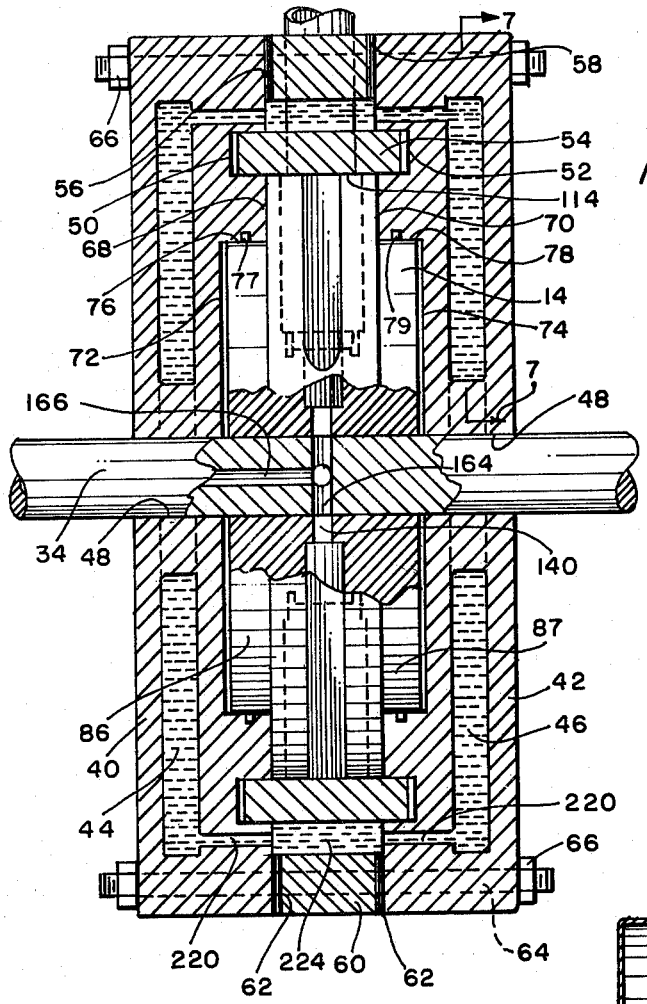
FIG. 3 is a sectional view taken on the plane of the section line 3—3 in FIG. 1.
Figure 5:
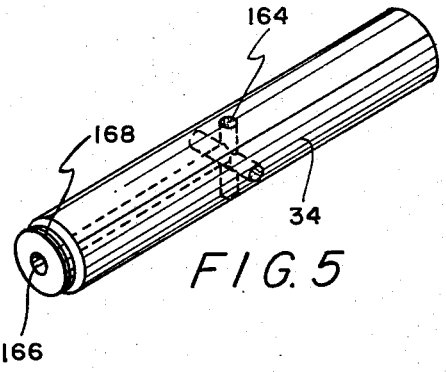
FIG. 5 is an isometric view of the rotor shaft.
Figure 6:
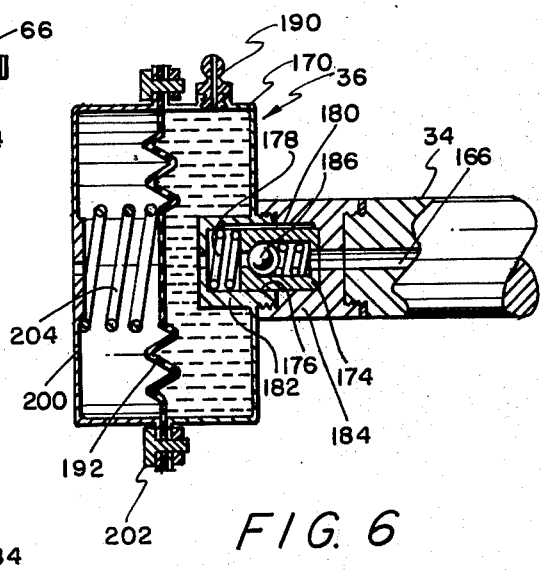
FIG. 6 is an enlarged sectional detail view of the combined fluid pressure reservoir and reversely operating check valve means.

Referring now to the drawings, wherein like numerals designate like parts throughout the various views, the reference numeral 10 designates the rotary engine generally.

The engine 10 comprises as its major components a housing 12 in which a rotor 14 is rotatably disposed. The housing 12 has various means for connection to fuel and air sources, the exhaust disposal, to electrical ignition energization, and to liquid coolant circulator and heat exchanger. The air and fuel source can be a conventional carburetor for supplying a combustible fuel-air mixture, or can as illustrated herein comprise an air inlet conduit 16 that is provided together with a liquid fuel supply conduit 18. The conduit 16 is conventionally coupled to a source of filtered or cleaned air (which may be supercharged, if desired) that is not shown, and the fuel supply conduit 18 is conventionally coupled to a fuel injection supply source, not shown, that provides pulsed metered quantities of fuel such as diesel oil or gasoline in synchronism with the rotation of the rotor 14. The exhaust conduit is shown at 20 and is conventionally connected to a muffler and a zone for safe disposal of the combustion products, not shown. The numeral 22 designates an insulated high tension electrical ignition lead that is conventionally connected to a source of electrical ignition energy that is not shown. The engine 10 is, of course, drivingly coupled to any suitable load via any desired form of transmission or clutch, not shown.

The housing 12 is coupled to a circulating liquid coolant system by conduits 24 and 26, the system including a conventional heat exchanger and pumping means not shown.

The rotor 14 is provided with or includes a plurality of four vane means designated at 28, 30, 32 and 34, and such rotor 14 is fixed on a shaft 34 that is rotatably journaled through the housing 12 with one end of such shaft 34 having a hydraulic pressure unit 36 mounted thereon, and the other end 38 of the shaft 34 constituting the power output shaft of the engine 10.

The housing 12 includes two substantially identical end sections 40 and 42 that are cast from any suitable metal such as suitable for ordinary internal combustion engine blocks. The housing sections are cast to include annular cooling cavities 44 and 46 respectively that are spaced about shaft openings 48 through which shaft 34 is journaled. If desired or deemed expedient conventional sealing type of insert bearings, not shown, can be fixed in the openings with the shaft 34 being sealingly journaled through such bearings, as will pose no problem to those of modest skill in the art.

Figure 9:
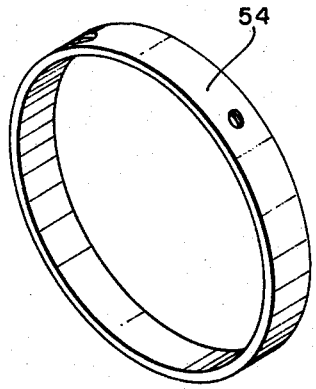
FIG. 9 is an isometric view of the resilient housing wall in repose.
Figure 8:
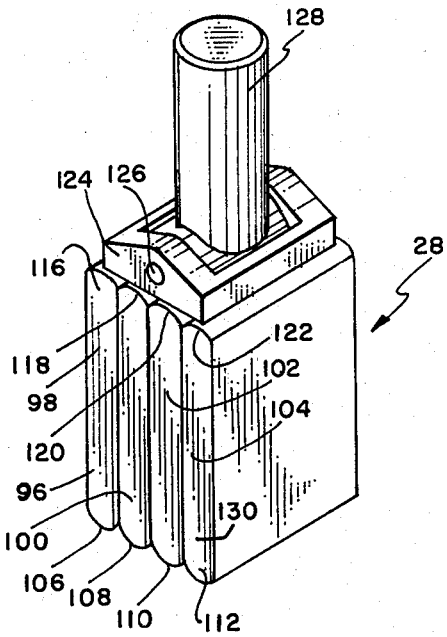
FIG. 8 is an enlarged isometric view of one of the vane means inclusive of its rocker seat.
Figure 10:
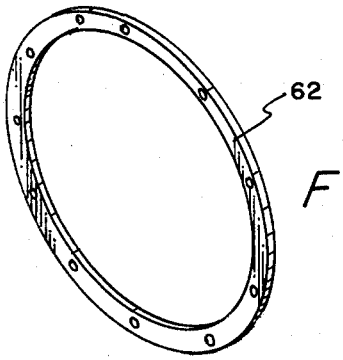
FIG. 10 is an isometric view of one of the housing seals.

The adjacent faces of housing sections are machined or milled to provide matching annular (though noncircular) grooves 50 and 52 within which is positioned a resilient annular, though noncircular, wall 54. The metallic and resilient wall 54, which can be a strip of stainless steel welded to form a circular cylinder in repose (as shown in FIG. 9) can be resiliently flexed to sealingly seat within and to smoothly take the noncircular configuration of the grooves 50 and 52 on the assembly or reassembly of the housing 12 (should replacement of the wall 54 become necessary). Peripherally outermost facing portions 56 and 58 of the sections 40 and 42 are machined and interposed between such machined face portions 56 and 58 is a metallic housing ring 60, with compressible sealing gaskets 62 such as the one shown in FIG. 10 are disposed on opposite sides of the ring 60. The sections 40 and 42 are secured by a plurality of axially extending steel rods or bolts 64 that extend as shown through the peripheral margins thereof and the intervening ring 60 and gaskets 62. The bolts 64 are threaded at their remote ends and provided with nuts 66 thereon whereby the degree of axial compression of the gaskets 62 can be controlled. The degree of compression of the gaskets 62 controls the spacing of the machined faces 68 and 70 that are immediately radially inward of the noncircular wall 54 for a purpose to be discussed presently.

The sections 40 and 42 are provided with facing circular cavities defined by facing wall surfaces 72 and 74, respectively, and by shoulders 76 and 78, respectively. Intermediate their axial extents, the circular shoulders 76 and 78 have "O" sealing rings 77 and 79 seated within suitable annular grooves therein for effecting seals with the rotor 14 in a manner presently to be set forth.

Figure 4:
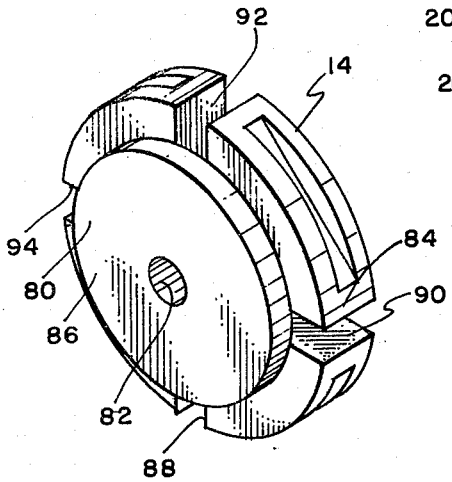
FIG. 4 is an isometric view of the body of the rotor.
Figure 7:
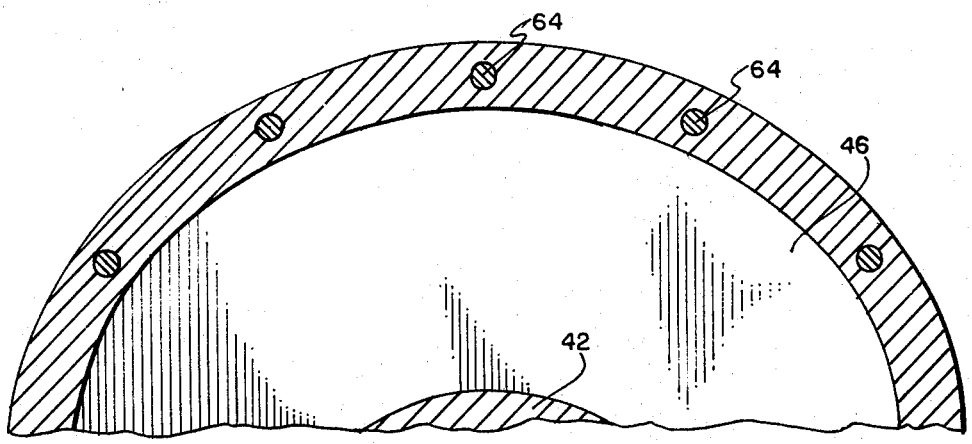
FIG. 7 is an enlarged fragmentary sectional view taken on the plane of the section line 7—7 in FIG. 3.

The rotor 14, as best shown in FIGS. 3 and 4, comprises an integral body 80, which can be a machined iron or aluminum casting that is symmetrical about its axis defined by a central opening 82 that accommodates the shaft 34. The rotor body 14 is also symmetrical about a medial plane normal to the axis of the opening, the body 80 having a central generally circular portion 84 and opposite axial portions 86 and 87 that are received in the sections 40 and 42 in spaced relation to the faces 72 and 74, respectively, and in closely spaced relationship to the shoulders 76 and 78 to make rotary sealing contact with the "O" rings or seals 77 and 79.

The central portion 84 of the rotor 14 is cut away at four positions equiangularly spaced about its axis to define guide ways 88, 90, 92 and 94 for the vane means 28, 30, 32 and 34, respectively. Since the vane means are all identical to each other, and since each of the vane means is related to its way and the remainder of the engine 10 in the same manner as the others, a detailed description of one of the vane means will suffice for all. Accordingly, it will be seen that the vane means 28 comprises a stack 96 of generally parallelepiped seal plates 98, 100, 102 and 104. The seal plates can be of any suitable material of low sliding friction characteristics and of such chemical and physical properties to withstand its chemical environment and the temperatures to which it will be subjected. The plates should have low sliding friction and be resistant to galling with respect to each other and also with respect to the materials of the noncircular wall 54 and the housing sections 40 and 42. It is deemed that the plates of the stack 96 can most conveniently be made of graphitic blocks such as are used in electrical machine brushes, or of a sintered metal incorporating within its porosity a high temperature and extreme pressure lubricant such as employed in so-called permanent bearings. Sintered bronze inpregnated with suitable lubricants such as conventional metallic sulfides can be used. Where temperature environments are not too high, the plates of the stack can be of Teflon (trademark of DuPont for a tetrafluoroethylene resin) or metal plates having Teflon bonded to their external surfaces.

The thickness and width of the stack 96 closely correspond to the dimensions of the way 88 and the plates of the stack are sealingly slidable radially in the way 88. The radially outer end edges 106, 108, 110 and 112 of each of the plates 98, 100, 102 and 104, which can be rounded slightly, are in operation of the vane means 28 radially urged outward (by means presently to be described) outward to maintain continuous sealing contact with the inner surface 114 of the noncircular annular wall 54. The opposite or radially inner ends 116, 118, 120 and 122 of the plates 98, 100, 102 and 104, respectively, are seated against a rocker 124 that is pivoted by a pin 126 to a solid cylindrical member 128 for a purpose later to be described.

The width of the plates 98, 100, 102 and 104 are such that their side edges, such as the one indicated at 130 are slidable against the faces 68 and 70 of the housing sections 40 and 42, and in this connection it will be noted that a minor tightening of the nuts 66 against the compressibility of the gaskets 62 compensate for initial wear in of the side edges of the seal plates and for such wear that occurs later during use, it being noted that such wear will be very small because of the very slight force of contact that tends toward zero.

Perhaps it would not be amiss at this time to note that the vane means 28 affords a plurality of seals relative to each of the sections 40 and 42 as well as to the housing wall 54. Such leakage as can occur must successively pass a series of seals, with the slight rounding of the end edges and side edges 106–112 and 130 making such multiple seals afford the highly efficient character that is well known in what are called labyrinth seals or glands.

The body 80 of the rotor 14 is provided with a system of internal passageways that afford internal fluid pressure communication between the radially innermost extents of all the ways 88, 90, 92 and 94. A radially extending passageway extends between each way and an annular groove 140 in the rotor body 80 that surrounds and opens toward the shaft 34, such passageway for way 88 and vane means 28 being designated at 142 in FIG. 2. Corresponding passageways 144, 146 and 148 are provided for vane means 30, 32 and 34 respectively. The passageway 142 slidingly receives the member or piston 128 of vane means 28 for radial reciprocation therein, the arrangement being such that fluid pressure existing in the groove 140 bears against the inner end of the piston 128 to urge hydraulically the rocker 124 and the plates of the vane means 28 radially outward. The force of the rocker against the inner ends of the plates aids in balancing radial forces exerted against the ends 106 and 112 of the plates in their interaction with noncircular wall 54. For example, when the wall 54 tends to force the plate 104 radially inwardly relative to the plate 98, such force is communicated to the latter also via the rocker. Similar considerations apply to the plates 100 and 102.

The groove 140 and the connected passageways 142, 144, 146 and 148 are such with the fact that the system has a constant overall volume and this fact in conjunction with the filling thereof with a fluid of relatively low viscosity as compared to lubrication greases (such as used in automotive chassis lubrication) that, apart from centrifugal effects, the pressures prevailing at the inner ends of all the ways 88–94 remain fairly constant at engine operating speeds despite each vane means reciprocating rather rapidly in and displacing fluid in its respective way.

It is preferred that the passageway system described above be filled with a liquid having as low a viscosity as practicable especially with respect to any radially outward leakage that might occur. To minimize fluid flow resistance it is preferred that the liquid have a viscosity at least as low as that of SAE 10w automotive oil and it is presently deemed preferable that the liquid have viscosity characteristics similar to those presently used in the automatic transmissions of passenger automobiles. Higher viscosities than that of SAE 10w oil can be used, however, such is believed to produce higher fluid flow resistance than ordinarily desirable. Low viscosity indexes are preferable also. Viscosities approaching those of what are customarily termed lubricating greases are deemed to be unsuitable and their use would essentially render the engine 10 inoperable.

It has already been mentioned that the liquid filled passageway system has an essentially constant overall volume despite the displacements of the vane means occurring by reason of the reciprocation of vane means as they track and seal against the noncircular wall 54. Such constant volume is the result of the identity of the various vane means and their 90° spacing from each other coupled with the inner surface 114 being definable by a polar equation having its origin at the axis of the shaft being such that the derivative of the radial distance of such surface with respect to the angular argument is the same in magnitude but opposite in sign for every 90° change in angular argument. In other words, during each increment of rotation of the rotor 14, the extent of radial movement of any one of the vane means is exactly equal and opposite to that of either one of the vane means immediately adjacent thereto.

Specifically the net displacement of all the vane means is zero at all times. Indeed, the net displacement of the vane means 28 and 30 is zero and a passageway 160 in the rotor 14 connects between the ways 88 and 90 as shown in FIG. 2 whereby pressure equilization therebetween is achieved. The passageway or breather opening 160 is as will be seen on reference to FIG. 2 disposed so as not to be obstructed by the piston 128. Preferably, though not necessarily, the passageway 160 is air rather than liquid filled. It will be noted that the pistons 128 serve to preclude hydraulic liquid being lost radially through the vane means. A similar passageway 162 couples the vane means 32 and 34. If desired or deemed expedient, additional passageways can couple vane means 28 to 34 and vane means 30 to 32.

Fluid pressure equalization about the groove 140 is aided by crossed passageways 164 through the shaft 34 that communicate with the groove 140, however, the purpose of the passageways 164 is to communicate with an axial passageway 166 that opens out of one end 168 of the shaft 34.

Such one end of the shaft 34 is radially reduced and externally threaded for connection to the previously mentioned means 36. The means 36 comprises a pressurized liquid reservoir 170 coupled to the passageway 166 by a valve means 172. The valve means 172 comprises a spool 174 biased within a barrel 176 by a spring 178 to close a bypass slot 180 in a wall of the barrel 176. The barrel 176 is defined in a wall 182 of the reservoir 170 and in a coupling member 184 threaded to the threaded end 168 of the shaft 34. The arrangement is such that a pressure differential in the passageway sufficiently in excess of that in the reservoir 170 will move the spool 174 to open the slot and allow liquid to pass into the reservoir 170. The spool 174 has ball check valve means 186 therein that is spring biased to preclude flow therethrough from the passageway means 166 to the reservoir but which will allow reverse flow when the pressure in the reservoir 170 exceeds that in the passageway means by a predetermined value.

The reservoir has a check valve type filler fitting 190 whereby liquid can be introduced to a predetermined pressure against a spring biased flexible diaphragm 192 or bellows. The diaphragm 192 is secured to the remainder of the reservoir by a ventilated cap 200 and threaded fasteners 202 with a coiled compression spring 204 being interposed between the diaphragm and the cap 200.

The means 36 maintains, considering the small quantities of liquid passing to and possibly from the passageway 166, a nearly constant liquid pressure. When the pressure falls to too low a value, fresh liquid is introduced through the unidirectional filler fitting 190.

The means 36 can of course accommodate any pressure surges from the passageway 166.

The positive pressure maintained in the passageway system of the rotor 14 by the means 36 constantly urges all the vane means outwardly and in contact with the wall 54. It is virtually superfluous to point out that the hydraulic scheme described above compensates for any wear of the radial ends of the vane means, and such would not be worthy of mention except that many prior proposals make no provision for wear and/or maintain an excessive force to maintain the sealing contacts.

The noncircular character of the wall 54 as it is forced to flex when seated in its grooves in the housing sections 40 and 42 is of a more or less generally elliptical shape that has the mathematical character previously ascribed to the same, the same having minimal radii at diametrically opposed positions 210 and 212 and equal maximum radii at diametrically opposed positions 214 and 216 that are displaced 90° from the positions 210 and 212.

The sections 40 and 42 are formed to afford continuous peripheral communication for the cavities 44 and 46 as indicated at 220 and 222 with space 224 between the wall 54 and the ring 60, and such cavities 44 and 46, the axial peripheral cavity extensions 220 and 222 together with the space 224 being filled with and forming a part of a liquid coolant circuit, it being noted that the inlet and outlet coolant conduits 24 and 26 are threaded through the ring 60 to communicate with the space 224 at circumferentially spaced positions. The coolant path includes the cavities 44 and 46 and the space whereby the wall 54 and the sections 40 and 42 are efficiently cooled.

The air inlet pipe 16 extends through an opening 230 in the ring 60, the space 224 and is threaded at 232 through an internally threaded opening in the wall 54 at a position intermediate positions 212 and 216. Means 234 including an externally threaded boss 236 on the ring and a gland nut and packing washer combination 238 afford sealing passage for the pipe 16 through the ring 60. The exhaust pipe 20 similarly threads at 240 through the wall 54 at a position intermediate positions 212 and 214. Means 242, similar to means 234, seal the passage of the exhaust pipe through the ring 60.

The section 42 has a fuel injector nozzle 250 extending therethrough at a position radially inwardly of the wall 54 and outwardly of the central portion 84 of the rotor 14. The nozzle 250 is circumferentially intermediate positions 216 and 210. The fuel line 18 is connected to the nozzle 250 by conventional means not shown.

A spark plug 252 extends through the housing section 42 and is radially intermediate the central rotor portion 84 and the wall 54 at a position circumferentially intermediate the positions 210 and 214. The spark plug 252 is connected to the high tension lead 22 by any conventional means not shown.

The central portion 84 of the rotor has grooves 254, 256, 258 and 260 intermediate the ways therein as clearly shown in FIGS. 2 and 4.

The operation of the engine 10 will require no description for those acquainted with the parent application and the references cited in the prosecution thereof, however, a few descriptive words may be helpful to the less initiated.

Variable volume traveling chambers are defined between the rotor 14 and the wall 54, such chambers being separated one from another by the vane means. A variable volume chamber 300 is defined between vane means 32 and 34; a chamber 302 between vane means 34 and 28; a chamber 304 between vane means 28 and 30; and a chamber 306 between vane means 30 and 32. The engine 10 is in its operation effectively a four-stroke cycle engine as will be seen. Each chamber 300–306 performs the four-stroke function on each revolution of the rotor 14, and this will be seen on following chamber 300 during one revolution of the rotor 14. Assume the rotor 14 is turning anticlockwise in which event chamber 300 will be increasing in volume in the position shown thereof in FIG. 2 and this corresponds to the intake stroke as air is drawn into the chamber 300 from the air inlet conduit 16. After the vane means 32 which trails the chamber 300 has passed the air inlet pipe 20, the chamber has reached its maximum volume and be commencing to shrink in volume and this corresponds to the compression stroke, it being noted that during such compression stroke that fuel enters the chamber 300 from the nozzle 250.

On the vane 32 having passed the nozzle 250, the chamber 300 will have reached its minimum volume and have thus completed its compression stroke. Further rotation of the rotor 14 is accompanied by the leading vane means 34 passing the spark plug 252 and with the volume of the chamber 300 increasing. The spark plug 252 is energized at this time and the fuel-air mixture is ignited to cause such expansion to constitute the power stroke. The spark plug 252 is cleared by the trailing vane means 32 upon the chamber 300 completing its power on expansion stroke, and further rotation results in the chamber 300 diminishing in volume and the leading vane means 34 uncovering the exhaust pipe 20 so as to constitute the exhaust stroke, further rotation entails the trailing vane means clearing the exhaust pipe 20 and entry upon the inlet stroke previously described.

The slots or kerfs 254–260 augment the minimum values of volumes of their respective chambers and effectively enable realization of reasonable or desired compression ratios that would otherwise be unreasonably high. Such kerfs enable the contained fluids to pass by the minimal radial position 210.

It will be understood that the resiliency of the wall 54 is such as to permit radial deformation of the same to the configuration of the grooves in which it is constrained, but of course is not such as to result in any departure from the form in which it is constrained in the grooves once it is assembled with the sections 40 and 42.

While the invention has been disclosed in its employment as an internal combustion engine, it is again pointed out that the principles of fluid pressure actuation of the vane means, the character of the latter and the structure of the non-circular wall are applicable to pumps and motors ported and valved in the usual fashion in such application. In connection with use in pumps, it is to be noted that the output pressure of a pump can be connected to urge radial outward vane movement of the vanes of such pump. Similarly, when employed as a steam driven motor or engine, the steam pressure applied to drive the motor can also be applied to urge the vanes of such motor radially outward in lieu of the provision of the means 36 for such purpose.

Reference is now directed to the appended claims.

I claim:

1. In a rotary fluid handling machine of the type wherein a rotor is mounted for rotation about its axis in a housing having a non-circular internal surface with said rotor being provided with a plurality of circumferentially spaced and radially movable vane means rotatable therewith each having a radially outermost end in relatively movable and sealing engagement with said internal surface, and wherein said rotor has in association with each of said vane means a way therein that sealingly and reciprocatingly receives such vane means therein during radial movements of the latter, the improvement comprising passageway means affording free fluid communication radially between inner portions of all said ways for substantially equalizing such fluid pressures as may exist at the inner portions of the ways during rotation of the rotor, and a second passageway means affording communication between the first mentioned passageway means and a fluid source disposed outside the housing, means for pressurizing said fluid source, and valve means for preventing fluid flow in either direction between the first mentioned passageway means and said source solely when the pressure differential therebetween falls within a predetermined range of values.

2. In a rotary fluid handling machine of the type wherein a rotor is mounted for rotation about its axis in a housing having a non-circular internal surface with said rotor being provided with a plurality of circumferentially spaced and radially movable vane means rotatable therewith each having a radially outermost end in relatively movable and sealing engagement with said internal surface, and wherein said rotor has in association with each of said vane means a way therein that sealingly and reciprocatingly receives such vane means therein during radial movements of the latter, the improvement comprising passageway means affording free fluid communication radially between inner portions of all said ways for substantially equalizing such fluid pressures as may exist at the inner portions of the ways during rotation of the rotor, a fluid having a viscosity less than about that of SAE 10w automotive motor oil filling said passageway means, a second passageway means for affording fluid communication between the first mentioned passageway means and a fluid source that is disposed externally of the housing, valve means for preventing fluid flow from the first mentioned passageway means to said source when the pressure differential favoring such flow is less than a predetermined amount, and means for bypassing said valve means when said pressure differential exceeds a predetermined value.

3. In a rotary fluid handling machine of the type wherein a rotor is mounted for rotation about its axis in a housing having a non-circular internal surface with said rotor being provided with a plurality of circumferentially spaced and radially movable vane means rotatable therewith each having a radially outermost end in relatively movable and sealing engagement with said internal surface, and wherein said rotor has in association with each of said vane means a way therein that sealingly and reciprocatingly receives such vane means therein during radial movements of the latter, the improvement comprising passageway means affording free fluid communication radially between inner portions of all said ways for substantially equalizing such fluid pressures as may exist at the inner portions of the ways during rotation of the rotor, a fluid having a viscosity less than about that of SAE 10w automotive motor oil filling said passageway means, said fluid being substantially incompressible, said vane means and the internal surface being arranged so that the total net displacement of all the vanes in their ways is substantially constant as the rotor rotates whereby the volumetric rate of fluid flow into the fluid passageway caused by the displacement thereof by radially inwardly moving vane means is continuously equal to the volumetric rate of displacement of the ways by radially outward moving vane means, said rotor being mounted on a shaft, a second passageway means in said shaft communication with the first mentioned passageway means and also being filled with said fluid, means for maintaining the fluid in the second passageway at a positive pressure, that includes a closed fluid reservoir coupled to second passageway means, said reservoir including a movable wall and means for yielding urging the movable wall to constrict the volume of the reservoir.

4. In a rotary fluid handling machine of the type wherein a rotor is mounted for rotation about its axis in a housing having a non-circular internal surface with said rotor being provided with a plurality of circumferentially spaced and radially movable vane means rotatable therewith each having a radially outermost end in relatively movable and sealing engagement with said inernal surface, and wherein said rotor has in association with each of said vane means a way therein that sealingly and reciprocatingly receives such vane means therein during radial movements of the latter, the improvement comprising passageway means affording free fluid communication radially between inner portions of all said ways for substantially equalizing such fluid pressures as may exist at the inner portions of the ways during rotation of the rotor, and a second passageway means affording communication between the first mentioned passageway means and a fluid source disposed outside the housing, means for pressurizing said fluid source, each of the vane means including a plurality of radially movable plates each contacting said inner surface, said plates being in sliding side-by-side engagement with each other upon a plane that is parallel to the axis of the rotor, whereby each vane means affords a plurality of sealing engagements with said inner surface as relative radial movements of the plates accommodate concurrent engagement of the plates with portions of the surface that are unequally spaced from the axis of the rotor, and a rocker disposed in each of said ways and in engagement with the radially innermost extremities of the plates, a piston sealingly operable in the first mentioned passageway means for radial movement with its associated vane means, said piston being pivotally secured to the rocker of its associated vane means about a pivotal axis parallel to the axis of the rotor, said first mentioned passageway means including branches communicating respectively between both the radially inner and outer ends of the pistons of circumferentially adjacent vane means.

5. In a rotary fluid handling machine of the type wherein a rotor is mounted for rotation about is axis in a housing having a non-circular internal surface with said rotor being provided with a plurality of circumferentially spaced and radially movable vane means rotatable therewith each having a radially outermost end in relatively movable and sealing engagement with said internal surface, and wherein said rotor has in association with each of said vane means a way therein that sealingly and reciprocatingly receives such vane means therein during radial movements of the latter, the improvement comprising passageway means affording free fluid communication radially between inner portions of all said ways for substantially equalizing such fluid pressures as may exist at the inner portions of the ways during rotation of the rotor, and a second passageway means affording communication between the first mentioned passageway means and a fluid source disposed outside the housing, means for pressurizing said fluid source, said housing having portions of circular transverse internal configurations at positions on axially opposite sides of the vane means, said rotor having portions of circular external transverse configuration on axially opposite sides of the vane means, said rotor portions being rotatably received within said portions of the housing, annular sealing means disposed intermediate each of said rotor portions and the housing portion within which it is disposed for preventing axial fluid movement therebetween, said housing comprising a pair of axially connected sections, said sections having facing sides having opposed noncircular annular grooves therein, and a resilient annular wall disposed between the sections and having opposite axial ends received in said grooves, the arrangement being such that the annular wall defines the noncircular inner surface of the housing

6. The combination of claim 5, wherein said facing sides of the housing sections axially bound said ways in the rotor.

7. The combination of claim 5, wherein said housing is provided with a confined void through which a fluid coolant may be circulated, with said void being in part bounded by said resilient annular wall.

8. The combination of claim 5, wherein said rotor and said housing are axially spaced from each other radially inwardly of each of said portions of the rotor.

9. In a fluid handling machine, wherein variable volume chambers disposed about an axis are in part defined by a noncircular inside surface of a housing, an improved housing comprising a pair of axially connected sections having facing sides, said sections having opposed noncircular annular grooves, and a resilient annular wall having opposite axial extremities received in said grooves in an arrangement such that the non-circular inside surface of the housing is defined by said wall.

10. In a rotary fluid handling machine of the type wherein a rotor is mounted for rotation about its axis in a housing having a non-circular internal surface with said rotor being provided with a plurality of circumferentially spaced and radially movable vane means rotatable therewith each having a radially outermost end in relatively movable and sealing engagement with said internal surface, and wherein said rotor has in association with each of said vane means a way therein that sealingly and reciprocatingly receives such vane means therein during radial movements of the latter, the improvement comprising passageway means affording free fluid communication radially between inner portions of all said ways for substantially equalizing such fluid pressures as may exist at the inner portions of the ways during rotation of the rotor, and a second passageway means affording communication between the first mentioned passageway means and a fluid source disposed outside the housing, means for pressurizing said fluid source, and a pair of oppositely directed unidirectional and biased valve means operatively interposed between the first mentioned passageway means and the fluid source.

11. The combination of claim 10, wherein said pair of valve means are coaxial with and rotatable with said rotor.

* * * * *